US009487349B2

(12) United States Patent
Götz et al.

(10) Patent No.: US 9,487,349 B2
(45) Date of Patent: Nov. 8, 2016

(54) ROUND CONTAINER FOR GERMINATING AND DRYING MALT

(71) Applicant: Schmidt-Seeger GmbH, Beilngries (DE)

(72) Inventors: Franz Götz, Kösching (DE); Michael Nieberler, Pollenfeld (DE)

(73) Assignee: SCHMIDT-SEEGER GMBH, Beilngries (DE)

( * ) Notice: Subject to any disclaimer, the term of this patent is extended or adjusted under 35 U.S.C. 154(b) by 0 days.

(21) Appl. No.: 13/765,252

(22) Filed: Feb. 12, 2013

(65) Prior Publication Data

US 2013/0212897 A1 Aug. 22, 2013

Related U.S. Application Data

(62) Division of application No. 12/508,933, filed on Jul. 24, 2009, now Pat. No. 8,397,366.

(30) Foreign Application Priority Data

Jul. 25, 2008 (DE) ..... 10 2008 034 659

(51) Int. Cl.
*B65D 90/08* (2006.01)
*B65D 90/02* (2006.01)
(Continued)

(52) U.S. Cl.
CPC ..... *B65D 88/08* (2013.01); *B65D 88/741* (2013.01); *B65D 90/023* (2013.01); *B65D 90/08* (2013.01);
(Continued)

(58) Field of Classification Search
CPC .... B65D 88/08; B65D 90/023; B65D 90/08; B65D 88/741; B65D 90/024; B65D 7/04; E04H 7/06; F26B 25/14; Y10T 29/49826; Y10T 29/49867; Y10T 29/49947; Y10T 29/49948; Y10T 29/49956; Y10T 29/53322
USPC ..... 29/428, 448; 220/4.14, 4.16, 4.17, 692, 220/693, 565, 648, 651
See application file for complete search history.

(56) References Cited

U.S. PATENT DOCUMENTS 953,827 A * 4/1910 Haas ..... 52/245
2,395,685 A * 2/1946 Schmitz, Jr. ..... 220/565
(Continued)

FOREIGN PATENT DOCUMENTS

CH 324 177 9/1957
DE 281 849 8/1990
(Continued)

OTHER PUBLICATIONS

EP 0471143 English Machine Translation; Rudolf Hauner; round container for containing wet and agressive materials, especially used for steeping, germinating and drying installastions in malting houses; Feb. 19, 1992; pp. 1-5.*

*Primary Examiner* — Christopher Besler
*Assistant Examiner* — Bayan Salone
(74) *Attorney, Agent, or Firm* — Hamre, Schumann, Mueller & Larson, P.C.

(57) ABSTRACT

The invention relates to a method for producing a round container and to a round container configured for said method, which provide faster construction of the round container, mostly independent from the precision of the preliminary work in spite of high final precision, and which provide simple transportation of the components to the construction site. This is accomplished by the invention through setting up wall profiles (2), which are continuous over the wall height of the round container (1) and which have in particular a flat inner surface, continuously along the circumference and by connecting them with one another and with the subsurface in particular through bolting.

15 Claims, 4 Drawing Sheets

(51) Int. Cl.

| | |
|---|---|
| ***B65D 88/08*** | (2006.01) |
| ***B65D 88/74*** | (2006.01) |
| ***E04H 7/06*** | (2006.01) |
| ***F26B 25/14*** | (2006.01) |

(52) U.S. Cl.

CPC ..... *F26B 25/14* (2013.01); *Y10T 29/49826* (2015.01); *Y10T 29/49867* (2015.01); *Y10T 29/49947* (2015.01); *Y10T 29/49948* (2015.01); *Y10T 29/49956* (2015.01); *Y10T 29/49968* (2015.01); *Y10T 29/53322* (2015.01)

(56) References Cited

U.S. PATENT DOCUMENTS

| | | | | | |
|---|---|---|---|---|---|
| 2,573,995 | A | * | 11/1951 | Sparling | 220/565 |
| 2,684,173 | A | * | 7/1954 | Schmitz | 220/645 |
| 2,875,866 | A | * | 3/1959 | Hess | 52/470 |
| 3,019,862 | A | * | 2/1962 | Bohnsack | 52/779 |
| 3,374,593 | A | * | 3/1968 | Rensch | 52/283 |
| 3,587,908 | A | * | 6/1971 | Nickel | 220/4.02 |
| 3,832,605 | A | * | 8/1974 | Clark, Jr. | 174/481 |
| 4,036,921 | A | * | 7/1977 | Ellen | 264/32 |
| 4,106,252 | A | * | 8/1978 | Rutten | E04D 3/366 52/464 |
| 4,109,440 | A | * | 8/1978 | Bill | 52/839 |
| 4,618,089 | A | * | 10/1986 | Hanada et al. | 228/212 |
| 4,718,208 | A | * | 1/1988 | Fons | 52/192 |
| 4,856,700 | A | * | 8/1989 | Sakaguchi et al. | 228/5.1 |
| 4,894,903 | A | * | 1/1990 | Woods | 29/448 |
| 4,953,734 | A | * | 9/1990 | Stohr | 220/4.02 |
| 4,988,032 | A | * | 1/1991 | Sakaguchi et al. | 228/102 |
| 4,989,751 | A | * | 2/1991 | Gillett | 220/565 |
| 5,033,178 | A | * | 7/1991 | Woods | 29/281.1 |
| 5,221,131 | A | * | 6/1993 | Lesperance et al. | 312/263 |
| 5,287,986 | A | * | 2/1994 | Frost | 220/565 |
| 5,289,942 | A | * | 3/1994 | Fawley | 220/565 |
| 5,384,998 | A | * | 1/1995 | Tanaka et al. | 52/630 |
| 5,806,702 | A | * | 9/1998 | Sabo | 220/4.12 |
| 5,816,424 | A | * | 10/1998 | Cannan et al. | 220/4.12 |
| 5,829,209 | A | * | 11/1998 | Keyl | 52/192 |
| 6,227,396 | B1 | * | 5/2001 | Small | 220/4.12 |
| 6,290,086 | B1 | * | 9/2001 | Franklin et al. | 220/564 |
| 6,321,930 | B1 | * | 11/2001 | Franklin et al. | 220/678 |
| 6,343,709 | B1 | * | 2/2002 | DeForrest et al. | 220/327 |
| 6,491,054 | B1 | * | 12/2002 | Small | 137/15.09 |
| 6,715,243 | B1 | * | 4/2004 | Fons | 52/192 |
| 6,739,469 | B1 | * | 5/2004 | Kim | 220/4.12 |
| 7,311,218 | B2 | * | 12/2007 | Varadarajan | 220/257.1 |
| 7,444,788 | B2 | * | 11/2008 | Morin et al. | 52/425 |
| 7,818,936 | B2 | * | 10/2010 | Morin et al. | 52/426 |
| 8,397,366 | B2 | * | 3/2013 | Gotz et al. | 29/428 |
| 2005/0016083 | A1 | * | 1/2005 | Morin et al. | 52/79.14 |
| 2009/0139171 | A1 | * | 6/2009 | Morin et al. | 52/332 |
| 2009/0242577 | A1 | * | 10/2009 | Dingeldein et al. | 220/650 |
| 2010/0018965 | A1 | * | 1/2010 | Gotz et al. | 220/4.01 |

FOREIGN PATENT DOCUMENTS

| | | | | |
|---|---|---|---|---|
| DE | 90 02 366 | | 9/1990 | |
| EP | 471143 | | 2/1992 | |
| EP | 471143 | A1 * | 2/1992 | B65D 90/08 |

* cited by examiner

ROUND CONTAINER FOR GERMINATING AND DRYING MALT

I. AREA OF APPLICATION

The invention relates to a method for producing a round container and it relates to a round container configured to be produced by said method, thus a container with a footprint which is circular in top view, or approximated thereto by a polygon.

II. TECHNICAL BACKGROUND

In particular in a malting process, process steps like germinating and kiln drying are performed in round containers, whose configuration is adapted to the respective process steps.

Such round containers were made from concrete or form steel in the form of tanks so far.

Round containers which are made of concrete have the disadvantage that their concrete configuration is complex and can often only be manufactured with difficulty with the required precision, in particular with respect to the circularity or the diameter.

The steel containers which are configured for storing liquids, similar to a tank, are assembled from a plurality of circular segments and are placed on top on one another in plural layers and welded together during construction.

In order to achieve sufficient stability, a plurality of stiffening elements and braces has to be installed along the circumference of the circular segments in the known circular containers made of steel.

The known round containers made of steel furthermore have the disadvantage that they are mostly assembled from large wall elements in order to keep the complexity of the joining operations low, thus, however, said segments can only be transported with complexity. After setting up a complete layer and welding it together, segments are placed onto the first layer in a respective second layer and welded together with one another and with the first layer.

Before setting up the first layer, before placing additional layers and before placing the eaves ring for connecting a roof to the round container, the circular segments are leveled relative to one another in the method for producing the steel tank, which creates substantially more complexity in the assembly process.

In the concrete—and also in the steel tank construction of the round containers, receivers for the respective inner furnishings have to be fabricated directly at the wall of the completely assembled round containers after setup.

This additional complex intermediary step which has to be performed satisfying high precision requirements substantially increases the complexity of construction and thus increases production costs.

III. DESCRIPTION OF THE INVENTION

Technical Object

Thus, it is the object of the invention to provide a method for producing a round container and a round container configured for said method and a wall segment which can be joined to form a round container, which wall segment facilitates a fast construction of the round container with substantial independence from the precision of the preparatory work, in spite of eventually being able to achieve a high level of precision and simple transportation of the components to the construction site.

Solution

Said object is accomplished by a method according to claim 1, by a round container according the claim 21 and by a wall segment according to claim 30. Further embodiments can be derived from the dependent claims.

A circular container according to the invention is configured from a plurality of wall profiles set up on a subsurface which are connected to one another and to the subsurface and which assure the stability of the round container without additional bracing. The round container obtains a shape similar to a cylinder along the preferably circular circumference through the set up wall profiles.

In one embodiment of the invention, the wall profiles comprise flat inner surfaces defining the round container, thus, the round container is approximated to a circle in top view through its polygon shape.

Furthermore, embodiments of the invention are conceivable, in which the inner surfaces of the cross sectional shape of the wall profiles are curved and form portions of a circular arc when viewing the container from the top.

Furthermore, embodiments of the invention are conceivable, in which the inner surfaces of the wall profiles comprise plural flat surfaces disposed at a angle to one another, which surfaces form a section of a polygon when a set up wall profile is viewed from the top, which polygon section is constant over the length of the wall profile and which is approximated to the circumference line of the round container.

The wall profiles have a width which is configured, so that the wall profiles on the one hand can easily be transported to the set up location of the round container, the shape deviation from a circular surface is small enough and simultaneously the width of the wall profiles is wide enough, so that the complexity of joining the plurality of wall profiles is not too great.

The wall profiles preferably comprise a length which corresponds to the wall height of the round container, this means they correspond to the height of the enveloping surface defining the round container. Thus, the height of the round container is determined by the selection of the length of the wall profiles.

It is the nature of the invention that the plurality of the wall profiles is set up and connected with one another along the circumference of the wall of the round container. Thus, it has proven advantageous that the wall profiles are only bolted to the sub surface and to the adjacent wall profiles when the wall profiles are set up.

The subsequent method is particularity advantageous for producing the round container according to the invention: before beginning the set up of the wall profiles a center of the round container to be produced is defined by marking it on the subsurface and by physically implementing it. For physically implementing the center, a screw anchor can be mounted into the ground, at which auxiliary devices can be mounted subsequently.

A circumference line is established about the center at the desired radius of the round container, which circumference line marks the extension of the inner wall of the subsequent round container, which inner wall extension is defined by the inner surfaces of the plurality of wall profiles.

In the subsequent step the circumference line is divided into segments and the segments are marked with segment markings. Preferably, the segment markings are distributed at identical distances on the circumference of the circumference line and mark a target arc section, which shall be covered by a defined number of the wall profiles forming the wall. The first wall profile is set up, so that the rear end of the wall profile is disposed at a starting point, from which a circle segment was measured as well, and so that the wall profile follows the circumference line starting at a start point. Thereafter, the wall profile is mounted at the subsurface, in particular bolted down. The second wall profile is set up, so that its rear end abuts to the front end of the first wall profile and so that it follows the circumference line. Thereafter, the second wall profile is mounted to the first wall profile and to the subsurface. The wall profiles following thereafter are disposed, so that their respective rear ends are adjacent to the front ends of the wall profile established last, aligned along the circumference line and mounted respectively to the wall profile set up last and mounted to the subsurface.

Thus, an enveloping surface with a polygonal base surface is created from the wall profiles, which enveloping surface is approximated to the circumference line.

While the wall profiles are set up, an undersize is measured along the circumference line of the subsequent round container after a defined number of wall profiles in an advantageous embodiment of the invention, which undersize corresponds to the deviation of the front end of the wall profile established last, from the segment marking at the end of the segment.

The measured undersize is thus compared with a predefined undersize threshold value, wherein a filler plate is attached to the end of the last wall profile in case the undersize is greater than the undersize threshold value. The filler plate comprises e.g. a height which corresponds to the height of the wall profiles and it comprises a thickness which substantially corresponds to the value of the undersize threshold.

For this purpose, the width of the wall profiles is configured with and undersize, this means the width of the wall profiles is insignificantly smaller than the width which was assumed for computing the target arc section and which was assumed for determining the position of the segment marking and for the particular number of wall profiles.

This means that an undersize is assured after a defined number of wall profiles through the small undersize of each wall profile, which undersize is determined respectively at the end of a circular segment through checking the end of the last wall profile against the position of the segment marker.

If the undersize is smaller than the undersize threshold value, or if no undersize is measured, another series of the defined number of wall profiles is directly attached to the last end of the defined number of wall profiles, wherein the undersize of the front end of the last wall profile of the second series is determined again with reference to the position of the associated segment marking after the setup of the second series, wherein after the setup of the second series, the undersize of the front end of the last wall profile of the second series is determined again with reference to the position of the associated segment marker, compared to the undersize threshold value and optionally compensated or reduced by inserting a filler plate.

Thus, depending on the production—and joining precision between the wall profiles, a filler plate is attached to the end of a series of wall profiles after a number of series of wall profiles, which number is not predetermined.

In another embodiment of the invention the wall profiles are configured, so that they are specifically produced for the radius of the subsequent round container. Preferably, the wall profiles are assembled from profiles which are substantially C-shaped in cross section, wherein the open sides of the C-profiles point outward in assembled state.

The C-profiles are substantially comprised of a center arm which configures the inner wall of the round container and they are configured from a first and from a second side arm which are angled relative to the center arm at both ends of said center arm.

The wall profiles are connected to the adjacent wall profiles at the side arms of the C-profiles. In order to adapt the wall profiles to the radius of the subsequent round container, the side arms of the C-profiles forming the wall profiles are bent relative to the center arm, so that the arms of adjacent wall profiles can be connected abutting to one another according to the subsequent radius of the round container, thus, in particular with a bending angle of slightly more than 90°. This way it is possible to provide a stable configuration for a round container which can be constructed in a simple manner.

Furthermore, manufacturing methods of the round container are conceivable in which wall profiles with identical configuration are used for round containers with different diameters. Thus, the wall profiles are positioned at the desired assembly angle relative to one another and in case a first side arm of the first wall profile does not have planar contact at the assembly angle with the side arm of a second wall profile which is to be connected to the first wall profile, spacer elements are inserted between the first and the second wall profile before bolting them together, in particular they are inserted at the outer end of the side arms.

When producing the round container, it is advantageous to join plural wall profiles to form a wall segment, before said wall profiles are set up and connected to the subsurface. A defined number of wall profiles are connected to form a wall segment, before they are set up, by bolting them together in a segment jig while lying flat.

Thus, a second jig for joining a wall segment from particular wall profiles preferably comprises the curvature of the circumference line of the round container, so that the wall profiles already contact the segment jig in assembly position. Thus, it is advantageous when the wall profiles contact the segment jig, so that the outside of the wall profiles contacts the segment jig and the inside of the wall segments faces upward for mounting an inner fairing and thus, it is completely freely accessible.

An inner fairing of a wall segment is preferably comprised of plural inner plates, preferably made of stainless steel, which are attached by welding, in particular along their circumference, to the wall profiles forming the wall segment. It is advantageous to perform said process step as long as the wall segment is disposed in the segment jig.

It the furthermore advantageous when the inner plates which are joined to form an inner fairing, are mounted to the wall segment overlapping like fish scales and thus welded in circumferential direction at their rear end at the prior inner plate and at their front end at the wall profile.

When a wall segment is assembled from a defined number of wall profiles, it is advantageous when the inner fairing protrudes beyond an end of the wall segment in circumferential direction. Thus, it is assured that the inner fairing of the first wall segment overlaps the inner fairing of second wall segment like fish scales when a first wall segment is joined with a second wall segment. Through the overlap of the inner fairings it is advantageous accomplished that the inner fairings of both wall segments are connected with one another through a weld along the overlapping end of the inner fairing of the first wall segment without substantial unevenness at the joint.

For simple and precise mounting of the inner furnishings, which are connected to the wall profiles through beams, it is advantageous for the wall profiles to be already provided with bore holes during production, which bore holes are exactly positioned for receiving the supports for the inner furnishings. After mounting the inner fairing to the wall segments or to the wall profiles, the mounting bore holes in the wall profiles which are prefabricated for receiving the beams, and thus the inner furnishings, are extended coaxially through the inner fairing, so that the supports for the inner furnishings can be mounted through the wall profile and through the inner fairing by a bolt connection.

Alternatively it is possible to weld the supports for the inner furnishings to the wall profiles. Thus, a cutout is fabricated in the inner fairing in the portion of a support at the wall element, so that the support directly abuts to the inner surface of the wall element through the cutout in the inner fairing. After placing the support in conformal contact it is preferably pre-positioned in the intended assembly position by a bolted connection, which interacts with the support through the prefabricated receiver of the wall profile. Subsequently, the support is welded to the wall profile at its end adjacent to the inner surface of the wall profile.

The cutout in the inner fairing preferably has a shape and size which assures on the one hand that the free end of the support is sufficiently assessable for performing the welding and on the other hand that no unnecessarily large opening is created in the inner fairing.

When producing the wall profiles, the receivers necessary for supporting the inner installed components, in particular the bore holes are fabricated into the respective wall profiles, thus depending on the configuration of the round container, the receiver, in particular the bore holes are fabricated in the wall profiles in the required number, size and at the desired position.

When setting up the wall profiles, wall profiles which comprise a receiver for a support are set up at predetermined positions. The positions of the wall profiles with a receiver are determined by the position of the supports to be received.

A round container according to the invention can thus comprise wall profiles with different receivers for the supports of the inner furnishings along the circumference, or it can also comprise wall profiles without receivers along the circumference.

In the embodiments of the invention in which a support is bolted and not welded to the wall profiles, the end of the support contacting the inner fairing is sealed along its circumference by a weld between the support and the inner fairing. Thus, it is prevented that liquids or solids can exit from the inner portion of the round container at the joints between the supports and the wall profiles.

In one embodiment of the invention the wall profiles are comprised of stainless steel. Thus, it is possible with this embodiment to omit a separate fairing. In order to assure a tight demarcation of the inner portion of the round container with the smallest unevenness possible by means of the wall profiles, the joining edges between two respective wall profiles bolted to one another are additionally welded together in this embodiment of the invention.

In order to assure that the height of the wall profiles is as even and identical along the circumference of the round container as possible, it is advantageous to level any unevenness of the ground by coarse leveling by leveling the wall segments or the wall profiles to a predetermined height e.g. by placing spacer elements under the wall profiles before setting up the wall segments.

After finishing the circumference surface of a round container, an eaves ring for mounting a cupola roof is generally placed onto the upper annular end of all wall profiles.

Depending on the application it is required that the round container comprises an outer fairing which is adapted to the application.

In the embodiment with C-shaped profiles as wall profiles it is advantageous when an outer fairing is mounted to the wall profiles from the outside by mounting a support beam to the wall profiles from the outside.

Thus, the side arms of the C-shaped wall profiles are bent over again at their free ends, so that they partially cover the open outer side of the C-profile. Support beams are inserted between the two bent over free ending fine arms of the C-profile, wherein the support beams are mounted with undersize at the free arms and mounted horizontally with reference to the free distance between the two free ending arms of the C-profiles.

After mounting the support beams at the wall profiles cover plates are mounted at the support beams, which cover plates stand vertically and form the outer shell for the round container. Trapezoid plates are particularly suitable as cover plates.

The intermediary spaces created between the wall profiles, the support beams and the cover surfaces are to be filled preferably with insulation material depending on the application of the round container in order to thermally insulate the interior of the round container relative to the ambient.

EMBODIMENTS

Embodiments according to the invention are described in an exemplary manner, wherein.

Figure 1:
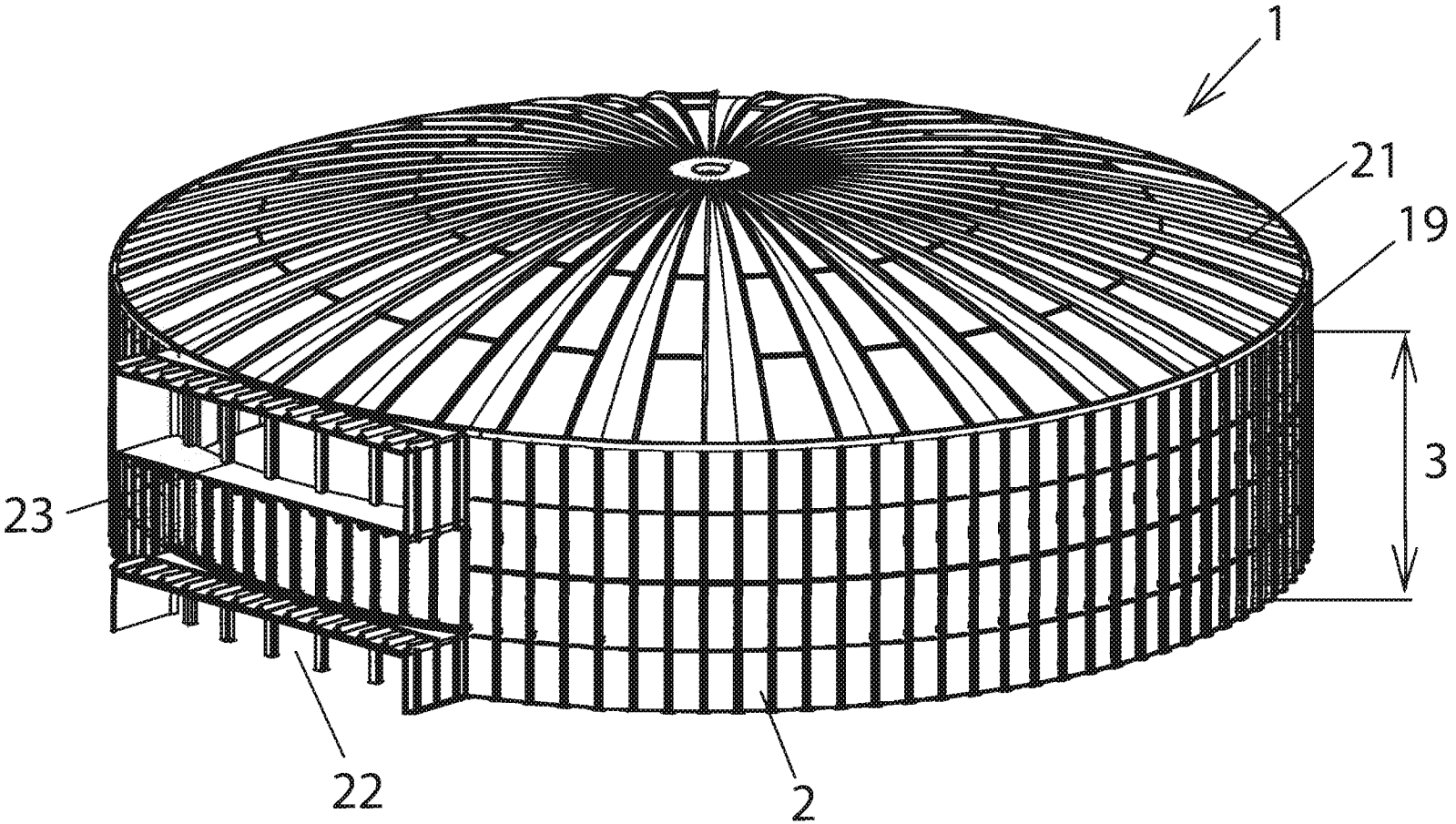
FIG. 1 shows a perspective illustration of a round container according to the invention.

The round container illustrated in FIG. 1 is substantially comprised of a plurality of a vertically standing wall profiles 2, which plurality forms an enveloping surface defining the round container and the round container is comprised of a cupola roof 21 placed thereon.

The wall profiles 2 are connected in groups one after the other at an assembly angle 25, so that the wall surface is created. The wall profiles are thus set up relative to one another, so that they follow the circular circumference line on the subsurface in a polygon shape. An eaves ring 19 is placed on the upper end of the enveloping surface, which eaves ring connects the cupola roof 21 covering the round container with the plurality of wall profiles 2.

The round container 1 comprises an air inlet 22 and an air outlet 23 at one location along the circumference at different elevations, which inlet and outlet are intended for supplying air to the round container 1 and for releasing air from the round container 1 and said inlet and outlet are provided by using custom profiles.

The wall profiles 2 are C-shaped in cross section and are comprised of a center arm 20*a* and comprised of bent over side arms 20*b* and 20*c* at both transversal ends of the center arm 20*a*. The extension of the center arm 20*a* visible in the cross section corresponds to the width of the profile 2.

The wall profiles 2 comprise a length which substantially corresponds to the wall height 3 to the round container 1.

The C-shaped wall profiles 2 are disposed along the enveloping surface of the round container, so that the inner surface 2*b* of the wall profile 2 which is disposed on the inside in radial direction 11 of the round container 1 is configured by the center arms 20*a* and the open sides of the C-shaped wall profiles 2 and the side arms 20*b* and 20*c* point outward in radial direction 11.

In the illustrated embodiment, the ends of the bent over side arms 20*b* and 20*c* which face radially outward in assembled position, are bent over one more time, so that the bent over ends 20*b*', 20*c*' of the side arms 20*b*, 20*c* partially cover the open outer side of the wall profile 2. thus, the ends 20*b*', 20*c*' of the side arms 20*b*, 20*c* are bent over, so that the ends 20*b*', 20*c*' extend substantially parallel to the center arm 20*a*.

At the radially inward oriented inner surface 2*b* of the wall profiles 2 an inner fairing assembled from plural inner plates 15 is mounted. The inner plates 15 are thin flat stainless steel plates which comprise a rectangular outline.

Figure 2:
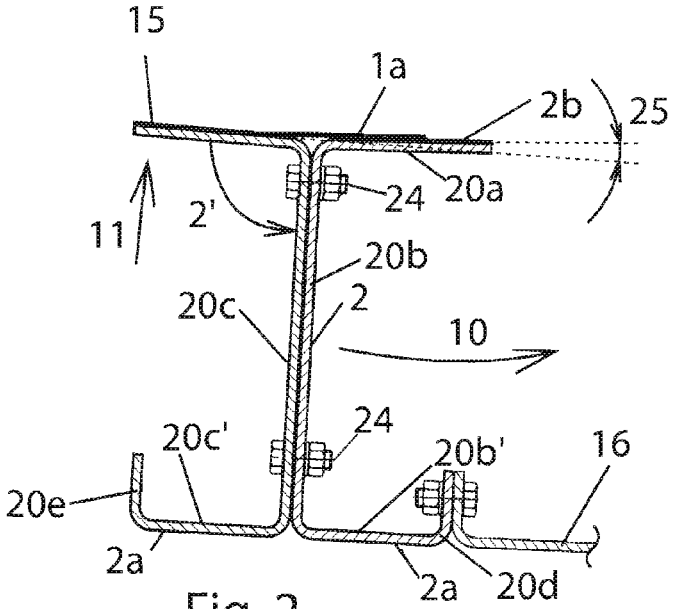
FIG. 2 shows a detail of a connection between two wall profiles.

In the embodiment of the invention shown in FIG. 2, in which the round container 1 is a germination box, the inner plates 15 comprise a longitudinal side with a length which substantially corresponds to the length of the wall profiles 2.

In order to mount an inner plate 15, it is placed against the inner surface 2*b* of the wall profiles 2 forming the enveloping surface of the round container, so that e.g. the longitudinal side of inner plate 15 extends substantially in parallel with the direction of extension of the wall profiles 2. The inner plate 15 is subsequently attached along one of its longitudinal sides to the wall profile 2 by means of a sport weld.

The second inner plate 15 joining the first inner plate 15 is applied to the inner surface of the wall profiles 2 forming the enveloping surface of the round container 1, so that a longitudinal side of the second inner plate overlaps the longitudinal side of the first inner plate, which longitudinal side is fixated at a wall profile 2 by means of the spot weld and so that the other longitudinal side of the second inner plate 15 conformally contacts the inner surface 2*b* of the wall profiles 2.

The second inner plate 15 is welded continuously along its longitudinal end to the first inner plate 15 at the longitudinal side of said second inner plate which second plate overlaps the first inner plate 15. The other longitudinal end of the second inner plate, which contacts the inner surface of the round container, is connected to the inner surface 2*b* of the wall profiles 2 by means of a tack weld.

Thus, an inner fairing is created, in which only the seams lie open at the overlapping ends or possibly at the longitudinal sides of the inner plates 15 and thus no gaps or larger uneven areas are provided in the inner fairing of the round container 1 formed by the inner plates 15.

The respectively adjacent wall profiles 2 are connected by bolts at an assembly angle 25. An angle is designated as assembly angle 25, by which a wall profile 2 is pivoted relative to a previously set up wall profile 2, based on an assembly in which the inner surfaces 2*b* of the two wall profiles 2 extend in parallel to one another, so that the circumference line 4 is approximated by the erected wall profiles 2.

In the embodiment shown in FIG. 2, the first and second side arms 20*b*, 20*c* of the wall profiles 2 are bent at a bending angle 2' relative to the center arm 20*a*, which bending angle is greater than 90° by half the assembly angle 25.

The side arms 20*b*, 20*c* of the wall profiles 2 in FIG. 2 are bent over twice, and thus form opposite arms 20*b*', 20*c*', extending substantially parallel to the center arm 20*a*, and the side arms form free ending arms 20*d*, 20*e*. The two free ending arms 20*d*, 20*e*, opposed to one another within a wall profile 2, constitute connection surfaces, where support beams 16 extending between the free ending arms 20*d*, 20*e* can be bolted down.

Figure 3:
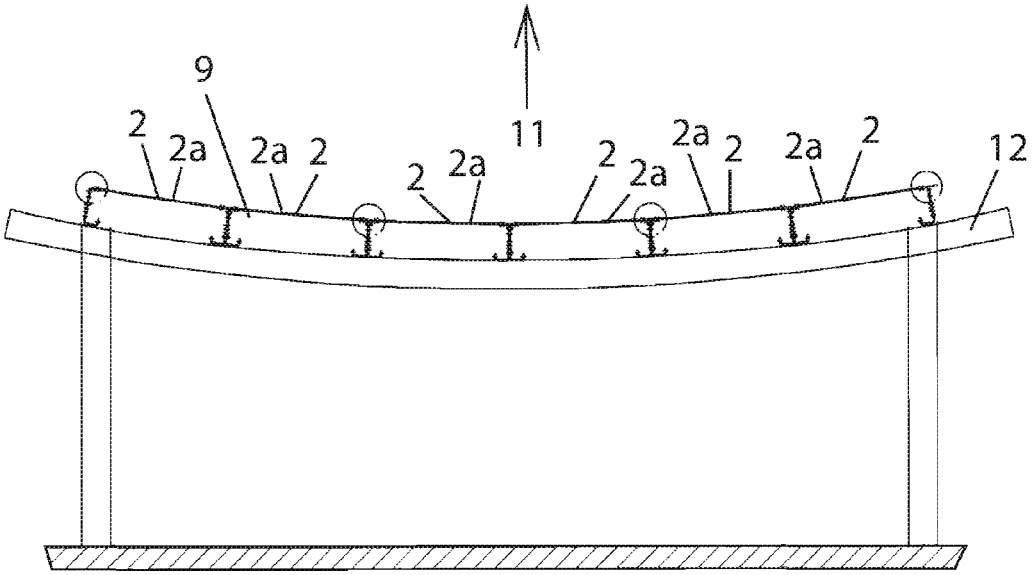
FIG. 3 shows a side view of a wall segment placed on a segment jig.

FIG. 3 shows a segment jig 12, where plural wall profiles 2, lying adjacent to one another with their center arms 20*a* oriented upward, are bolted together to form a wall segment 9 before being set up, and wherein inner plates 15 for an inner fairing are mounted to the wall profile 9, while lying on the segment jig 12.

The segment jig 12 comprises a curvature which assures that the wall profiles 2 bearing on the segment jig 12 are positioned substantially at the right assembly angle 25 relative to one another. Thus, the wall profiles 2 can be connected with one another in the segment jig, so that the inner surfaces of the wall profiles joined to form a wall segment 9, form a polygon section, which polygon section is approximated to the curvature of the circumferential line 4 of the round container 1.

The wall profiles 2 are placed onto the segment shape 12, so that the inner surfaces 2*b* of the wall profile 2 face away from the segment jig 12. Thus, the inner surfaces for mounting the inner plates 15 are freely accessible.

In order to mount the inner fairing, inner plates 15 are mounted from the top at the inner surfaces 2*b* of the wall profiles 2 in the configuration of a segment jig shown in FIG. 3.

Mounting the inner plates 15 at the wall profiles 2 is preferably performed as described supra with inner plates overlapping one another like fish scales.

The inner fairing of a wall segment 9 is mounted, so that the inner fairing protrudes in circumferential direction 10 beyond one end of the wall segment 9. Thus, the inner fairing of a wall segment 9 overlaps the inner fairing of an adjacent wall segment 9, after setting up and assembling two wall segments 9.

After connecting the adjacent wall segments 9, the end of the inner fairing protruding beyond the axial end of a first wall segment 9 bears on the inner fairing of the subsequent wall segment 9, this means, both inner fairings overlap like fish scales.

The overlapping end of the inner fairing of the wall segment 9 is welded to the inner fairing of the adjacent wall segment 9 along the overlapping longitudinal end. This assures that the inner fairing comprises also only minor surface unevenness due to the welds between two wall segments 9.

Figure 4A:
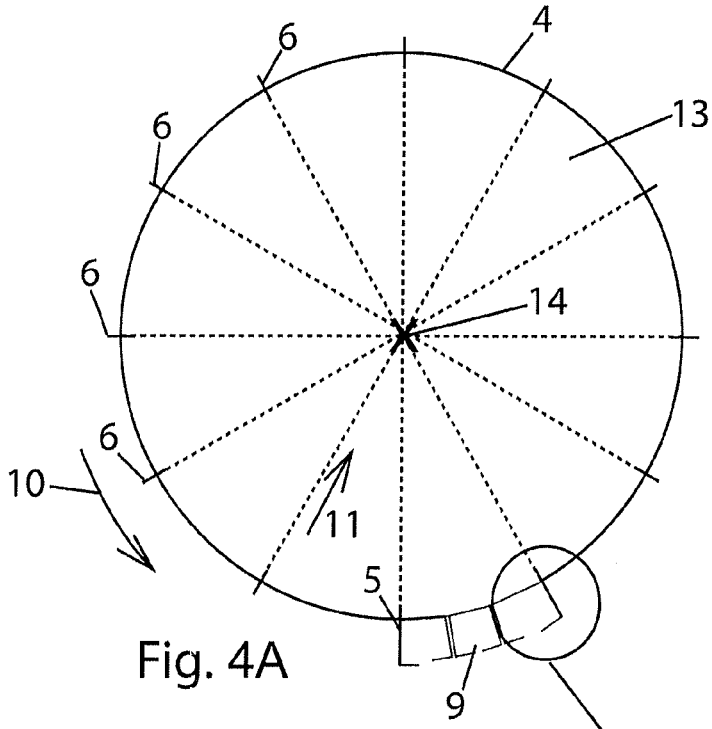
FIG. 4A shows a top view of the subsurface of the round container and illustrates a center point.
Figure 4B:
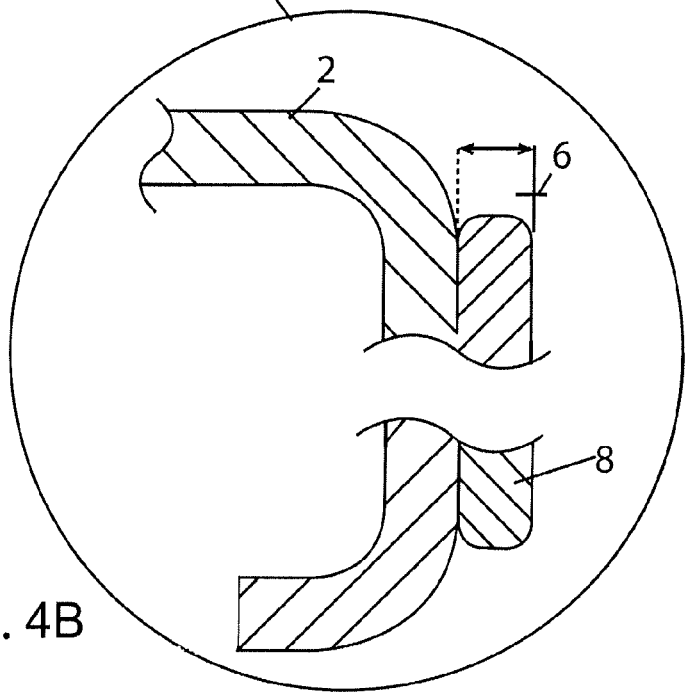
FIG. 4B shows a detail of a cross-section of a wall profile and a filler plate.

Before setting up the wall profiles 2 or the wall segments 9, a center point 14 is preferably marked on a subsurface 13, as shown in FIG. 4*a*, and said center point is physically implemented, so that it is fixated. A circular circumference line 4 is drawn about the center point 14 at the radius of the inner surface of the round container to be produced, which circumference line is used as an orientation for setting up the wall profiles 2 and the wall segments 9.

In a subsequent step, the circumference line 4 is divided into target arc sections 6*a* of equal size and the ends of the target arc sections 6*a* are characterized by one segment marker 6 respectively. The target arc sections 6*a* define a segment of the enveloping surface of the round container 1, which is to be configured by a defined number of the wall profiles 2, or by a wall segment 9.

Subsequently, the setup process is described with reference to an embodiment of the invention in which a defined number of wall profiles 2 is joined to form a wall segment 9 before being set up.

However, said procedure is also possible without the preassembly of a defined number of wall profiles 2 to form a wall segment 9 by setting up a defined number of wall profiles 2 one after the other, starting at a starting point, and moving along the circumference line 4 and bolting them to the subsurface 13 and to one another, instead of setting up a wall segment 9.

A wall segment 9 is placed at the starting point 5 of the circumference line 4 and bolted to the subsurface 13 along the circumference line. Thus, a first target arc section 6*a*, which starts at the starting point 5, is covered by the set up wall segment 9.

Thereafter the distance of the end of the wall segment 9, which is the end of the last wall profile 2 of the wall segment 9 in circumferential direction, is measured relative to the position of the associated segment marker 6 in circumferential direction. In the subsequent step, a filler plate 8 is mounted to the end 9*a* of the wall segment, if the deviation is greater than a predefined undersize threshold value 7. The filler plate 8 comprises a length which corresponds to the length of the wall profile 2, a width which corresponds to the length of the side arms 20*b* or 20*c*, and a thickness which approximately corresponds to the undersize threshold value 7.

Through the flush mounting of a connection plate 8 with its ground surface at the outside of a side arm 20*b*, 20*c* contacting the end of the wall segment 9, thus the undersize of the wall segment 9, which corresponds to the distance of the end of the wall segment 9 to the segment marker 6, is corrected or reduced.

In the subsequent step, another wall segment 9 is mounted to the end of the first wall segment 9, and disposed in circumferential direction 10 at the end of the first wall segment.

Figure 5:
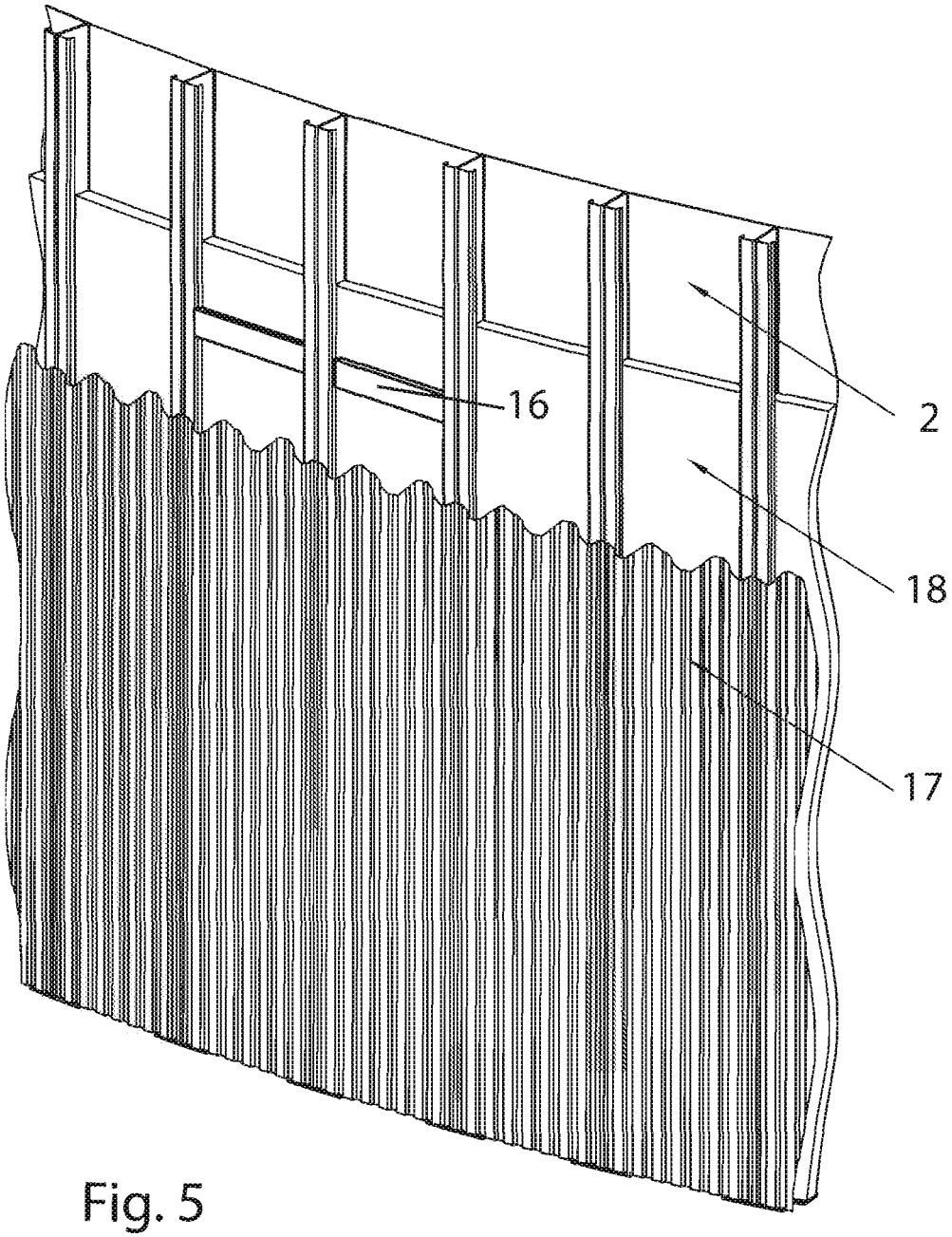
FIG. 5 shows a perspective view of the outer fairing of the round container.

In order to cover the round container 1 from the outside, cover plates 17, in particular trapezoid, are mounted to the radially outward oriented open sides of the wall profiles 2 as illustrated in FIG. 5.

The cover plates 17 are connected with a plurality of support beams 16, which are mounted to the wall profiles 2. In FIG. 5, two support beams 16 are illustrated as examples for the plurality of the support beams 16, which are mounted respectively between two free ending arms 20*d*, 20*e* of the wall profiles 2.

In particular in the embodiment of the round container 1 as a germination box, an insulation layer 18 is inserted into the intermediary spaces defined by the wall profiles 2 and the cover plates 17, so that the inner cavity of the round container 1 is insulated relative to the ambient.

Mostly before placing the roof, the installations in the interior of the round container 1 are performed, which are still necessary.

REFERENCE NUMERALS AND DESIGNATIONS

1 round container
1*a* inner wall
2 wall profile
2' arm angle
2*a* outside
2*b* inner surface
3 wall height
4 circumference line
5 start point
6 segment marking
6*a* target arc section
7 undersize threshold value
8 filler plate
9 wall segment
9*a* end of wall segment
10 circumferential direction
11 radial direction
12 segment jig
13 subsurface
14 center point
15 inner plates
16 support beam
17 cover plate
18 insulation chamber/insulation
19 eaves ring
20 C-profile
20*a* center arm
20*b* first side arm
20*c* second side arm
20*d,e* free ending arms
21 cupola roof
22 air inlet
23 air outlet
24 mounting means
25 assembly angle

The invention claimed is:

1. A round container, in particular a germination box or a drying kiln in a malting operation, which is set up on a subsurface, the round container comprising:

a circumferential wall having a wall height, the circumferential wall including:

a plurality of vertically standing unitary wall profiles disposed along a circumference line, wherein a height of each of the vertically standing unitary wall profiles is the wall height of the round container, the vertically standing unitary wall profiles are bolted to the subsurface and to one another, and the vertically standing unitary wall profiles are comprised of:

a center arm and a bent over side arm bent at a bending angle relative to the center arm, the bending angle being greater than 90°, wherein the side arm is bent over twice, thus forming an opposite arm which extends substantially parallel to the center arm, and a free ending arm bent from the opposite arm.

2. The round container according to claim 1, wherein the circumferential wall includes special profiles different from the vertically standing unitary wall profiles, wherein the special profiles have reduced heights for generating air inlet and air outlet openings.

3. The round container according to claim 1, further comprising:

at least one filler plate, the filler plate including a thickness which substantially corresponds to an undersize target value threshold, the filler plate mounted between two vertically standing unitary wall profiles in order to compensate for an undersize of the vertically standing unitary wall profiles along a circumferential direction.

4. The round container according to claim 1, wherein the vertically standing unitary wall profiles include flat inner surfaces, which face radially inward in the assembled state of the round container.

5. The round container according to claim 1, wherein the vertically standing unitary wall profiles include radially inward oriented inner surfaces in an assembled state of the round container, which include a constant curvature over the length of the vertically standing unitary wall profile, which curvature substantially corresponds to the curvature of the circumference line.

6. The round container according to claim 1, wherein the vertically standing unitary wall profiles include radially inward oriented inner surfaces in an assembled state of the round container, wherein the inner surfaces are at least bent over once over the length of the vertically standing unitary wall profile and wherein the inner surface describes a polygon section visible in top view, which is approximated to the circumference line.

7. The round container according to claim 1, wherein the vertically standing unitary wall profiles are closed in an outward direction through cover plates, wherein the cover plates are mounted to support beams, the support beams being permanently connected to the free ending arms of the vertically standing unitary wall profiles and extending between two free ending arms of the vertically standing unitary wall profiles, wherein a radially outer surface of the support beams is aligned with a radially outer surface of the opposite arm.

8. The round container according to claim 1, wherein an insulation chamber is defined by the vertically standing unitary wall profiles, support beams and cover plates, into which insulation chamber insulation material can be filled.

9. The round container according to claim 1, wherein a wall segment is assembled from a plurality of the vertically standing unitary wall profiles bolted to one another, wherein the vertically standing unitary wall profiles are assembled at defined assembly angles, so that the wall segment includes the curvature of the subsequent circumference line, and an inner fairing is mounted to inner surfaces of the wall segment.

10. The round container according to claim 9, wherein the inner surface includes at least one inner plate and the inner fairing reaches beyond the wall segment on one side along a circumferential direction.

11. The round container according to claim 9, wherein inner plates are disposed at the inner surface of the wall segment, so that the inner plates overlap with one another along a circumferential direction like fish scales.

12. The round container according to claim 9, wherein inner plates are made from stainless steel.

13. The round container according to claim 9, wherein the vertically standing unitary wall profiles are made of stainless steel.

14. A round container, in particular a germination box or a drying kiln in a malting operation, which is set up on a subsurface, the round container comprising:

a circumferential wall having a wall height, the circumferential wall including:

a plurality of vertically standing unitary wall profiles disposed along a circumference line, wherein a height of each of the vertically standing unitary wall profiles is the wall height of the round container, the vertically standing unitary wall profiles are bolted to the subsurface and to one another, and the vertically standing unitary wall profiles are comprised of:

a center arm and a bent over side arm bent at a bending angle relative to the center arm, the bending angle being greater than 90°, wherein the side arm is bent over twice, thus forming an opposite arm which extends substantially parallel to the center arm, and a free ending arm bent from the opposite arm, wherein support beams are insertable between two bent over free ending arms of the plurality of vertically standing unitary wall profiles and mountable between the two bent over free ending arms of the plurality of vertically standing unitary wall profiles.

15. A round container, in particular a germination box or a drying kiln in a malting operation, which is set up on a subsurface, the round container comprising:

a circumferential wall having a wall height, the circumferential wall including:

a plurality of vertically standing unitary wall profiles disposed along a circumference line, wherein a height of each of the vertically standing unitary wall profiles is the wall height of the round container, the vertically standing unitary wall profiles are bolted to the subsurface and to one another, and the vertically standing unitary wall profiles are comprised of:

a center arm and a bent over side arm bent at a bending angle relative to the center arm, the bending angle being greater than 90°, wherein the side arm is bent over twice, thus forming an opposite arm which extends substantially parallel to the center arm, and a free ending arm bent from the opposite arm, and a filler plate having a thickness which substantially corresponds to an undersize target value threshold to compensate an undersize of the wall profiles is attached to an end of a defined number of the plurality of vertically standing unitary wall profiles.

* * * * *